US008544629B2

(12) United States Patent
Nutzel

(10) Patent No.: US 8,544,629 B2
(45) Date of Patent: Oct. 1, 2013

(54) DEVICE AND METHOD FOR RECEIVING OR DISPENSING BANK NOTES

(75) Inventor: Dominik Nutzel, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 13/382,714

(22) PCT Filed: Jul. 7, 2010

(86) PCT No.: PCT/EP2010/059758

§ 371 (c)(1),
(2), (4) Date: Jan. 6, 2012

(87) PCT Pub. No.: WO2011/003955

PCT Pub. Date: Jan. 13, 2011

(65) Prior Publication Data

US 2012/0111694 A1 May 10, 2012

(30) Foreign Application Priority Data

Jul. 8, 2009 (DE) ..... 10 2009 032 228

(51) Int. Cl.
*G07F 7/04* (2006.01)

(52) U.S. Cl.
USPC ..... 194/207; 902/15

(58) Field of Classification Search
USPC ..... 194/207, 342, 344; 221/12, 13, 221/210, 220; 271/3.15, 3.17, 265.01, 265.02, 271/265.03; 49/31; 902/15, 17
See application file for complete search history.

(56) References Cited

U.S. PATENT DOCUMENTS

| | | | | |
|---|---|---|---|---|
| 4,320,854 | A | 3/1982 | Hirose | |
| 4,337,864 | A * | 7/1982 | McLean | 209/534 |
| 5,577,589 | A | 11/1996 | Tinoco | |
| 8,167,135 | B2 | 5/2012 | Nutzel et al. | |
| 2008/0284085 | A1 | 11/2008 | Curina et al. | |
| 2009/0133986 | A1 | 5/2009 | Thum et al. | |

FOREIGN PATENT DOCUMENTS

| | | | |
|---|---|---|---|
| DE | 10239227 | | 3/2004 |
| DE | 102007056998 | A1 | 5/2009 |
| DE | 102007062119 | A1 | 6/2009 |
| EP | 0374366 | A2 | 6/1990 |
| EP | 0540867 | | 12/1993 |
| EP | 0602775 | | 6/1994 |
| WO | 2007057471 | | 5/2007 |

OTHER PUBLICATIONS

English translation of IPRP in PCT/EP2010/059758, Jan. 26, 2012.
International Search Report in PCT/EP2010/059758, Oct. 11, 2010.

* cited by examiner

*Primary Examiner* — Mark Beauchaine
(74) *Attorney, Agent, or Firm* — Bacon & Thomas, PLLC

(57) ABSTRACT

A method for accepting and/or dispensing/returning bank notes wherein bank notes to be accepted or dispensed/returned are transported from or to an input and dispensing position to or from a processing position. At least an input velocity for the bank notes is ascertained upon an input of bank notes to be accepted, or at least a withdrawal velocity for the bank notes upon the dispensing/return of bank notes to be dispensed/returned is ascertained, and the bank notes to be accepted are transported at a transport velocity corresponding substantially to the input velocity or withdrawal velocity, whereas the bank notes to be dispensed/returned are transported at a transport velocity corresponding substantially to the withdrawal velocity or input velocity.

11 Claims, 2 Drawing Sheets

DEVICE AND METHOD FOR RECEIVING OR DISPENSING BANK NOTES

BACKGROUND OF THE INVENTION

1. Field of the Invention

The present invention relates to an apparatus and a method for accepting or dispensing/returning bank notes.

2. Related Art

Apparatuses for accepting or dispensing/returning bank notes are known. Known apparatuses are based on the idea that a pocket that is employed for inputting bank notes to be accepted is also employed for returning bank notes that could not be accepted, e.g. because they could not be recognized or because disturbances occurred during processing. Furthermore, the pocket can be employed for dispensing bank notes.

From DE 102 03 176 B4 there is moreover known such an apparatus for accepting or dispensing/returning bank notes wherein a stack of loose bank notes is input into an opening of the apparatus or withdrawn from the opening. From or to this opening the entire stack of bank notes is transported for further processing or withdrawal of the bank notes. For this purpose there is provided a transport system with an upper and a lower portion between which the stack of bank notes is clamped for transport, for which purpose for example the upper portion of the transport system is moved toward the lower portion of the transport system on which the stack of bank notes rests. Upon the dispensing/return of bank notes it is provided here to transport the stack of bank notes so far that the stack of bank notes protrudes out of the opening in order that the bank notes can be grasped by an operator.

Because bank notes are to be prevented from falling out of the opening of the apparatus upon the dispensing/return of the bank notes, the bank notes are normally transported only so far that they protrude out of the opening by less than half of their dimension. Moreover, the bank notes can still be clamped by the transport system in order to reliably prevent their unintentionally falling out.

Through these measures for preventing the bank notes from falling out, it is more difficult for the operator to withdraw the bank notes from the apparatus when they protrude out of the opening. For the operator must pull the bank notes out of the apparatus over a considerable path against the clamping force of the transport system. If the clamping is done without, on the other hand, the bank notes can be withdrawn by the operator more easily, but there is a higher risk of the bank notes falling out unintentionally.

In addition, it is known from the application DE 10 2008 030 878.1 from the applicant that the bank notes to be dispensed/returned are transported out of the input and dispensing position by a specified length, whereupon the transport of the bank notes to be dispensed/returned is stopped and it is monitored whether the bank notes are being moved out of the apparatus by the operator, whereupon the bank notes are transported out of the apparatus again if the motion of the bank notes is detected upon monitoring.

The last-stated application already supports the operator considerably and takes account of the operator's behavior upon the withdrawal of bank notes to a certain extent, thereby making it possible to avoid the problem of bank notes accidentally falling out. However, there are not known from the prior art any apparatuses and methods for accepting or dispensing/returning bank notes that adapt to the individual habits of the operators upon the input or withdrawal of bank notes. This leads, on the one hand, to an uncomfortable situation for the operator upon operation. On the other hand, it has been found that precisely the lack of adaptation to individual operating habits results in operation errors. Such operation errors arise because the operators gain the impression at certain times that the input or withdrawal is not being continued automatically.

SUMMARY OF THE DISCLOSURE

The object of the present invention is to state an apparatus and a method for accepting or dispensing/returning bank notes that take account of individual habits of operators upon the input or withdrawal of bank notes by the operator upon the acceptance or dispensing/return of the bank notes.

The invention starts out here from a method for accepting or dispensing/returning bank notes wherein bank notes to be accepted and/or dispensed/returned are transported from or to an input and dispensing position to or from a processing position. According to the invention there is ascertained at least an input velocity for the bank notes upon an input of bank notes to be accepted, or at least a withdrawal velocity for the bank notes upon the dispensing/return of bank notes to be dispensed/returned, and the bank notes to be accepted are transported at a transport velocity corresponding substantially to the input or withdrawal velocity, whereas the bank notes to be dispensed/returned are transported at a transport velocity corresponding substantially to the withdrawal or input velocity.

The advantage of the invention is in particular to be seen in that the bank notes are moved through the transport system upon the acceptance and/or dispensing/return at a velocity that is adapted to the input or withdrawal velocity of the respective operator upon the input or withdrawal of the bank notes. This leads to a more comfortable operating process. Moreover, it avoids operation errors that frequently arise upon an unadapted velocity upon the acceptance or dispensing/return of bank notes. For such operation errors result for example when the velocity upon the automatic draw-in of the bank notes is lower than the velocity at which the bank notes are input by the operator. In this case the operator gains the impression that the automatic draw-in process of the bank notes into the input pocket is not being continued, or continued properly, for which reason the operator holds on to the bank notes or attempts to pull them out of the input pocket. Similar operation errors also result in the event that the bank notes are automatically drawn in at a velocity that is higher than the velocity at which the operator inputs the bank note. Accordingly, operation errors result upon the automatic dispensing of the bank notes if the velocity thereof does not correspond to the velocity of withdrawal by the operator.

Further advantages of the present invention result from the dependent claims and from the following description of an embodiment according to the invention with reference to figures.

DESCRIPTION OF THE DRAWINGS

There are shown

DETAILED DESCRIPTION OF PREFERRED EMBODIMENTS OF THE INVENTION

Figure 1:
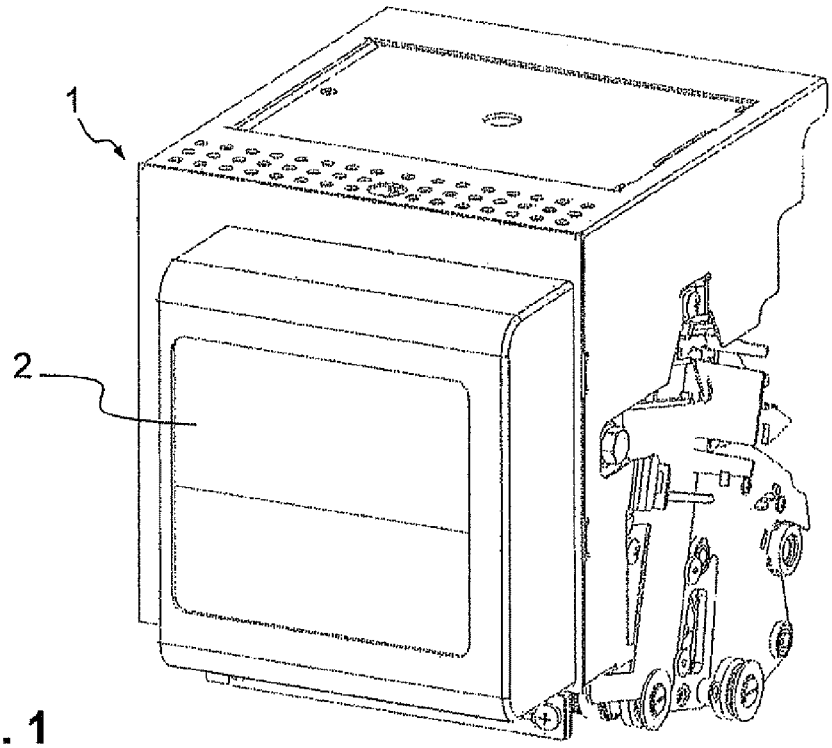
FIG. 1 an embodiment of an apparatus for accepting or dispensing/returning bank notes, having an opening closed by a cover, FIG. 2 the apparatus for accepting or dispensing/returning bank notes according to FIG. 1 without a cover, and FIG. 3 a transport system arranged in the apparatus for accepting or dispensing/returning bank notes according to FIG. 1, for transporting stacked or individual bank notes.

In FIG. 1 there is represented an embodiment of an apparatus 1 for accepting or dispensing/returning bank notes, having a pocket for accepting or dispensing/returning bank notes which has an opening 2' closable by a cover or visor 2 as the input and dispensing position.

Figure 2:
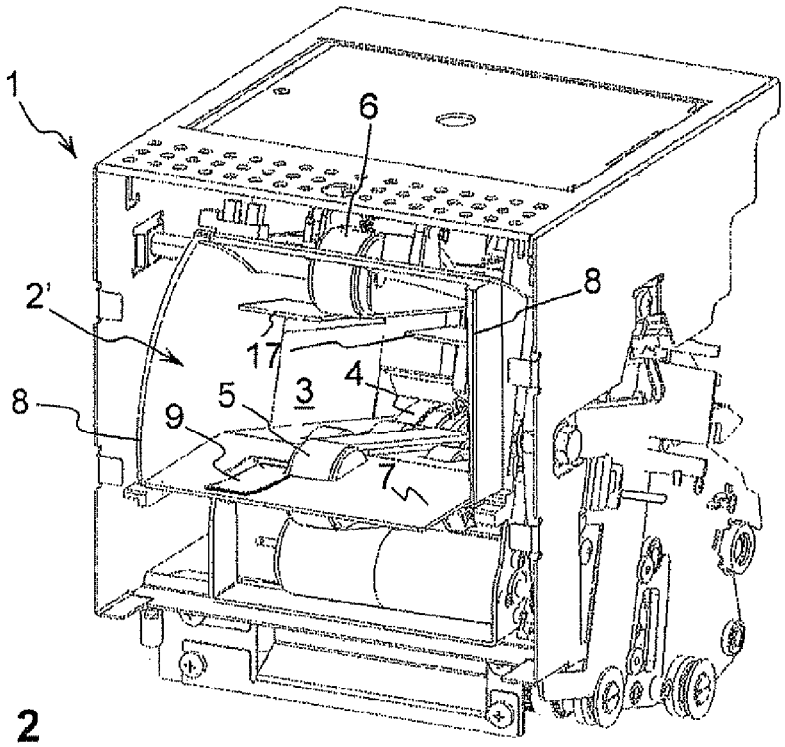

FIG. 2 shows the embodiment of the apparatus 1 for accepting or dispensing/returning bank notes represented in FIG. 1, whereby the cover 2 has been removed to permit an unobstructed view of the opening 2' of the pocket 3 for accepting or dispensing/returning bank notes. Thus, one can see components 4 of a singler for singling bank notes. Additionally there is represented a transport system 5, 6 consisting of a first, upper portion 6 and a second, lower portion 5, whose function will be described more precisely hereinafter. The transport system 5, 6 is located in its starting position in which the upper portion 6 of the transport system 5, 6 is maximally moved away from the lower portion 5. The dimensioning of a distance thereby resulting between the upper and lower portions of the transport system 5, 6 depends substantially on a maximum amount of bank notes to be transported, i.e. the distance is dependent on the thickness of the stack formed by the bank notes to be accepted and/or dispensed/returned. In the represented embodiment, the transport system is formed by belts. However, it is evident that a roller transport system or a differently constructed transport system can also be employed.

Figure 3:
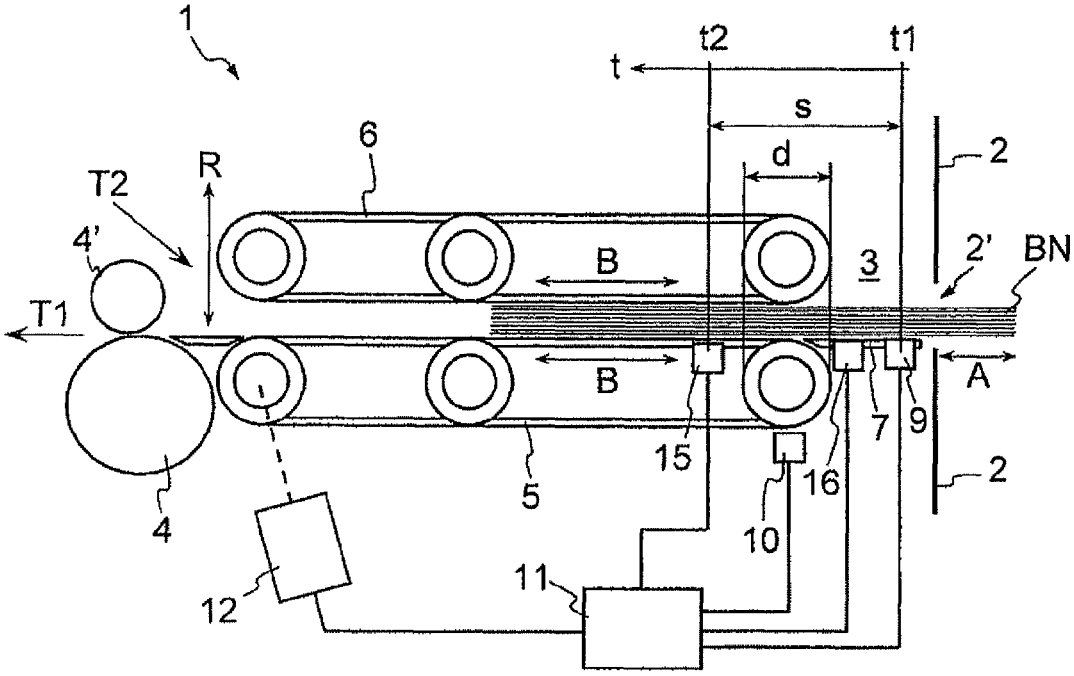

FIG. 3 shows the transport system 5, 6 of the apparatus 1 for accepting or dispensing/returning bank notes after bank notes BN have been input by an operator into the pocket 3 limited by side walls 8 (see FIG. 2) and a support means 7. Through the dimensioning of the cover 2 and of the parts receiving it (not represented), the opening 2' is defined such that the bank notes BN cannot be input by the operator up to the end of the pocket 3, i.e. up to the singler 4, 4' consisting of a singling roller 4 and a retaining roller 4'. On the other hand, the bank notes BN can be input into the pocket 3 so far that they lie safely in the pocket 3 and do not fall out after the operator releases them. The dimensioning of pocket 3, cover 2 and the parts receiving cover 2 is dependent on the size of the bank notes to be input and should make it possible for the bank notes to be input into the pocket 3 by more than half of the longitudinal dimension of the largest bank note. Alternatively or additionally, it can be provided that upon the input of the bank notes BN into the pocket 3 a sensor 9, e.g. a light barrier or a light scanner, ascertains the input of the bank notes BN, whereupon the transport system 5, 6 takes over the bank notes BN within the pocket 3 and clamps them, as described hereinafter. It is thereby achieved, on the one hand, that the bank notes BN cannot be input by the operator up to the singler 4, 4'. On the other hand, the bank notes BN cannot fall out of the pocket 3 unintentionally.

After or during the input of the stack of bank notes BN, the upper portion of the transport system 6 is moved in the direction of the lower portion 5 along the travel path R for example by means of a parallel drive until the bank notes BN are clamped between the lower portion 5 and the upper portion 6. The upper portion 6 can, in so doing, be brought by means of a spring into a spring-loaded position, so that the bank notes are held between upper portion 6 and lower portion 5 by a defined clamping force. As described above, the moving of the upper portion 6 can be controlled by evaluation of a signal of the light barrier 9. However, there can also be present further sensors 15, 16, e.g. light barriers or light scanners. The upper portion 6 of the transport system 5, 6 is then moved in the direction of the lower portion 5 when both light barrier 15 and light barrier 16 are covered by the bank notes BN. Thus it is ensured that the bank notes BN are located in the area of the transport system 5, 6. For the evaluation of the signal of the light barriers 9, 15, 16 and of the control of the transport system 5, 6 and of further components of the apparatus 1 there can be provided a control device 11, for example a microcomputer.

After the clamping of the bank notes BN there can be derived from the position of the upper portion 6 of the transport system 6 a first estimate of how many bank notes BN have been input, i.e. the number of the bank notes BN to be accepted can be approximately determined. This also allows a detection of whether the maximum admissible amount of bank notes has been exceeded, e.g. the input of more than 100 bank notes. In this case the acceptance process can be terminated and the operator can be asked to withdraw the bank notes BN and to input a smaller amount of bank notes.

Upon the acceptance of bank notes BN, the bank notes BN clamped between upper portion 6 and lower portion 5 are transported by the transport system 5, 6 into the pocket 3. In so doing, both portions 5, 6 of the transport system 5, 6 are advantageously driven. However, it is also possible, as represented in FIG. 3, to drive only one of the portions 5 or 6, e.g. the lower portion 5 by means of a motor 12 which is controlled by the control device 11. The bank notes BN are transported completely into the pocket 3, so that the cover 2 can be closed. After the closing of the cover 2 the upper portion 6 of the transport system 5, 6 can be moved away from the bank notes BN or the clamping can at least be loosened and the bank notes BN can be singled by means of the singler 4, 4' and be transported individually in the direction T1 in the apparatus 1 for further processing.

Subsequently there is effected the processing of the input bank notes BN, i.e. their acceptance. For this purpose, the apparatus 1 for accepting and/or dispensing/returning bank notes is connected to a bank-note processing device. The bank-note processing device can have for example a transport device, a sensor device, a storage device for bank notes, e.g. one or several cassettes for different types of bank note, a temporary store for storing bank notes during processing, etc.

If errors occur upon processing, the acceptance can be terminated and it can be provided that the input bank notes BN are returned wholly or partly to the operator. Likewise, bank notes not recognized upon processing, bank notes grasped in double or multiple fashion by the singler 4, 4', etc., can be returned to the operator. For this purpose, the bank notes BN to be returned are transported in the direction T2 out of the apparatus 1 into the pocket 3. To separate the bank notes to be returned from the input bank notes not yet singled, there can be provided a separating element 17 (FIG. 2). Bank notes that are to be dispensed and stem e.g. from the above-mentioned cassettes of the apparatus 1 are also transported in the direction T2 into the pocket 3. The upper portion 6 of the transport system 5, 6 is located at this time for example in its starting position in order to make room in pocket 3 for the bank notes to be dispensed/returned.

When all the bank notes to be dispensed/returned are located in the pocket 3, the upper portion 6 of the transport system 5, 6 is moved along the travel path R against the bank notes BN until the latter are clamped. The bank notes BN are thereafter transported by the transport system 5, 6 in the direction of the cover 2 and the cover 2 is opened. The stack of bank notes BN is transported by the transport device 5, 6 until the bank notes BN protrude out of the opening formed by the cover 2 so far (length A) that the operator can grasp the bank notes BN and withdraw them. The transport of the bank notes out of the opening is controlled here for example through evaluation of the signals of the light barrier 9 through the control device 11. After the leading edge of the bank notes 9 has been detected by the light barrier 9, the motor 12 or drive of the transport system 5, 6 is still operated for a certain time span which results from the transport velocity of the transport system 5, 6 and the specified length A by which the bank notes BN are to project beyond the cover 2.

When the bank notes BN are grasped by the operator and pulled out of the apparatus, a sensor 10, e.g. a clock generator, which is advantageously equipped with a rotational direction detection, captures the motion of the stack of bank notes BN through the operator. Such a clock generator can have for example a clock disk which is seated on a shaft of the transport system and has a transmitter and receiver for recognition of clock lines. For the rotational direction detection, the clock disk has two different clock line systems which are captured by transmitter and receiver upon the rotation of the clock disk. Through evaluation of the signals of the receiver, e.g. in the control device 11, the rotation and the direction of the rotation are detected.

For easier removal of the bank notes BN from the apparatus 1, the transport system 5, 6 clamping the stack of bank notes BN can have play B. Advantageously, the size of the play B is fixed such that the stack of bank notes BN can be moved so far that at least a certain, specified number of clock lines can be captured by transmitter and receiver of the clock generator 10. As soon as the control device 11 detects by the signals of the clock generator 10 that the bank notes BN are being grasped and pulled out of the apparatus 1 by the operator, i.e. the specified number of clock lines has been counted, the control device 11 starts the drive or motor 12 of the transport system 5, 6 in order to transport the stack of bank notes BN out of the apparatus 1 and thus support the operator.

The drive or motor 12 can be switched off by the control device 11, e.g. after the evaluation of the signal of the light barrier 9 yields that the trailing edge of the stack of bank notes BN has passed the light barrier 9. Finally, the control device 11 can in addition cause the upper portion 6 of the transport system 5, 6 to be moved back to its starting position to make possible for example a new input of bank notes BN. For controlling the drive or motor 12, the signals of the clock generator 10 can also be evaluated by the control device 11. For example, the drive 12 can be switched off after a certain number of clocks of the clock generator 12 that corresponds to the length A that the bank notes BN protrude out of the opening formed by the cover 2.

The above-described play B of the transport system 5, 6 can in addition be held at full stop via a restoring force, e.g. a return spring. When the operator stops pulling on the bank notes BN, the restoring force acts. Thus it can be ascertained by the control device 11 that the operator is no longer pulling on the bank notes BN. The control device 11 can then stop the drive or motor 12 of the transport system 5, 6 in order that they are not transported completely out of the clamping of the transport system 5, 6 and fall out of the opening formed by the cover 2. During the dispensing of the bank notes supported by the drive or motor 12, the control device 11 can continually check whether the operator is still pulling on the bank notes in order to prevent the bank notes BN from unintentionally falling out as described above.

In the event that the operator forgets to withdraw from the pocket 3 the bank notes BN to be dispensed/returned, the bank notes BN to be returned, e.g. 20 seconds after they were presented to the operator, are transported by the transport system 5, 6 under the control of the control device 11 into the pocket 3 again and the cover 2 is closed. Subsequently, the bank notes BN to be dispensed/returned are singled and kept in the bank-note processing device connected to the apparatus 1 for accepting or dispensing/returning bank notes, e.g. in one of the above-described cassettes, or a special container for forgotten bank notes.

Upon the input of bank notes BN by the operator for acceptance of the bank notes BN by the apparatus, it is in addition ascertained by a sensor at what input velocity $V_E$ the bank notes BN are input into the pocket 3 by the operator. For this purpose, the above-described light barriers or light scanners 9, 15, 16 can be employed. If there are employed for example the light barriers 9 and 15 which have a distance apart corresponding to a path s, the input velocity $V_E$ can be ascertained by ascertaining the times at which the bank notes trigger the light barriers 9, 15. If the first light barrier 9, from the input point of view, is triggered by the bank notes BN input by the operator at a time t1, and the light barrier 15 therebehind, from the input point of view, at a time t2, there results the input velocity $V_E$ at which the bank notes are input into the pocket 3 by the operator according to equation (1).

$$V_E = \frac{s}{t1 - t2} \tag{1}$$

Subsequently, the bank notes BN are clamped between upper portion 6 and lower portion 5 and transported automatically by the transport system 5, 6 into the pocket 3, as upon the above-described acceptance of the bank notes BN. For this purpose, the control device 11 calculates according to the equation (1) at what input velocity $V_E$ the bank notes BN were input by the operator. On the basis of the ascertained input velocity $V_E$ and the known design data of the transport device 5, 6 that are stored in the control device 11, the drive 12 is controlled by the control device 11 such that the bank notes upon acceptance are transported through the transport system 5, 6 at a velocity corresponding substantially to the input velocity $V_E$ of the input of the bank notes BN by the operator.

In addition, for the withdrawal of bank notes BN by the operator upon the dispensing or return of bank notes BN, there can also be ascertained by a sensor at what withdrawal velocity $V_A$ the bank notes BN are withdrawn from the pocket 3 by the operator. For this purpose, the above-described clock generator 10 can be employed. When, for example, the bank notes BN projecting beyond the cover 2 by the specified length A are grasped by the operator, it is made possible by the play B that the bank notes BN can be pulled out of the pocket 3 by the operator. In so doing, the control device 11 detects by evaluation of the clock signals of the clock generator 10 whether and in which direction the bank notes BN are being moved by the operator. When the bank notes BN are removed from the pocket 3, the control device 11 can moreover ascertain the withdrawal velocity $V_A$ of the withdrawal. For this purpose there are stored in the control device 11 the known design data of the transport device 5, 6, in particular a diameter d of the shaft or roller of the transport system, to which the clock generator 10 is connected, and the total number of clocks of the clock generator 10 around its entire circumference. The withdrawal velocity $V_A$ of the withdrawal of the bank notes BN by the operator upon a dispensing or return of bank notes BN results according to equation (2).

$$V_A = \frac{\text{Captured clocks} \cdot \pi \cdot d}{\text{Total number clocks} \cdot t} \tag{2}$$

Captured clocks signifies here the clocks emitted by the clock generator 10 and captured by the control device 11 during a specified time period t during which the withdrawal of the bank notes by the operator's pulling is monitored.

As described above, after capture of the removal of the bank notes BN from the pocket 3, the drive 12 is started by the control device 11 in order to support the operator's withdrawal of the bank notes BN to be dispensed or returned. In so doing, the control device 11 controls the drive 12 such that the transport velocity of the bank notes BN through the transport system 5, 6 corresponds substantially to the ascertained withdrawal velocity $V_A$ of the withdrawal of the bank notes BN by the operator.

Instead of the hitherto represented and described embodiment wherein the bank notes are transported parallel to their long edges, it is of course also possible to transport the bank notes parallel to their short edges. In this case, all components of the apparatus 1 for accepting and/or dispensing/returning bank notes must of course be dimensioned accordingly.

Likewise, it is possible that individual bank notes can also be accepted and/or dispensed/returned with the apparatus, rather than a stack of bank notes.

Further, besides bank notes to be accepted or dispensed, there can also be contained checks, vouchers or other value documents. These are processed together with the bank notes or separately, and kept for example in a special cassette of the storage device of the bank-note processing device connected to the apparatus 1 for accepting or dispensing/returning bank notes.

If there occur disturbances upon the singling of bank notes BN by means of the singler 4, 4', the transport system 5, 6 can also be employed for eliminating these disturbances. In particular, bank notes jammed in the gap of the singler 4, 4' can be drawn out by means of the transport system 5, 6 if the jammed bank note still protrudes into the pocket 3 so far that it can be grasped by the transport system 5, 6. The jammed bank note and any further bank notes still located in the pocket 3 are then transported in the direction of the cover 2 and the jammed bank note is freed again upon transport into the pocket 3. The further bank notes located in the pocket 3 can abut the cover 2 in this process, thereby being deformed. After freeing of the jammed bank note, the transport direction of the transport system 5, 6 is reversed and the further bank notes are transported to their original position again. Alternatively or additionally, the upper portion 6 can also be moved away from the bank notes, so that the deformed further bank notes move to their original position again on account of the deformation.

Should serious disturbances occur, the upper portion 6 and/or the above-mentioned separating element can be brought into their starting position, so that the space of the pocket 3 is completely open and grants the operator or a service person access to the singler 4, 4'. Likewise, the cover 2 can for this purpose be opened completely to make the entire space of the pocket 3 more easily accessible.

In the above description it has been assumed that a velocity for the input, and a velocity for the withdrawal, of the bank notes by the operator are ascertained. Deviating therefrom, however, only one of the two velocities can also be ascertained. This can be the case for example when the apparatus is only provided for inputting or only for dispensing bank notes. Furthermore, it has been found, however, that most operators both input and withdraw bank notes at a similar velocity. For this reason, it may also suffice to ascertain only the velocity for input, or only that for withdrawal, of the bank notes by the operator. Expediently, the velocity is ascertained upon the first operating process by the operator. Thus, when bank notes are first input, the input velocity is ascertained at which the operator inputs the bank notes. Thereupon, the transport system is controlled upon the acceptance of bank notes such that the bank notes are transported into the pocket at a transport velocity corresponding substantially to the ascertained input velocity. Upon a subsequent dispensing/return of bank notes, the transport system is controlled such that the bank notes are transported out of the pocket at a transport velocity likewise corresponding substantially to the previously ascertained input velocity.

The invention claimed is:

1. An apparatus for accepting or dispensing/returning bank notes, having a transport system for transporting the bank notes to be accepted or dispensed/returned by the apparatus within a pocket, from or to an opening of the pocket to or from a processing position bordering on the pocket, wherein the bank notes are clamped for transport between a first portion and a second portion of the transport system, comprising:

a control device configured to control the components of the apparatus;

said control device arranged to ascertain, at least upon an input of bank notes to be accepted through the opening into the pocket, an input velocity through evaluation of signals of a sensor arranged in the area of the pocket, or at least upon a withdrawal of bank notes to be dispensed/returned through the opening out of the pocket a withdrawal velocity through evaluation of signals of a sensor connected to the transport system;

said control device configured to control the transport system upon the acceptance of bank notes such that the bank notes are transported into the pocket at a transport velocity corresponding substantially to the input velocity or the withdrawal velocity; and said control device configured to control the transport system upon the dispensing/return of bank notes such that the bank notes are transported out of the pocket at a transport velocity corresponding substantially to the withdrawal velocity or the input velocity.

2. The apparatus according to claim 1, wherein the sensor that ascertains the input velocity comprising at least two light barriers or light scanners.

3. The apparatus according to claim 1, wherein the sensor that ascertains the dispensing velocity comprises a clock generator.

4. The apparatus according to claim 1, wherein the apparatus is configured so that bank notes to be dispensed/returned are configured to be transported by the transport system by a specified length out of the opening and held there, whereupon the control device is configured to stop the transport system and to evaluate signals of the sensor in order to ascertain whether the bank notes are being moved out of the apparatus, whereupon the control device starts the transport system again in order to transport the bank notes out of the apparatus.

5. The apparatus according to claim 1, wherein the transport system has play.

6. The apparatus according to claim 5, wherein the play is provided with a restoring force which causes a restoration of the play as soon as the bank notes are no longer being moved out of the apparatus, and the control device is arranged to continually check during the transport of the bank notes out of the apparatus whether the restoration has been effected, and in such event, to stop the transport system.

7. The apparatus according to claim 1, wherein the sensor ascertains whether the bank notes have been removed from the pocket, and the control device is arranged to stop the transport system when the bank notes have been so removed.

8. A method for accepting or dispensing/returning bank notes using an apparatus having a transport system and a control device configured to transport the bank notes to be accepted or dispensed/returned from or to an input and dispensing position to or from a processing position using the transport system, said method comprising the steps:

at least ascertaining an input velocity for the bank notes upon an input of bank notes to be accepted using a sensor connected to the control device and configured to ascertain the input velocity, or at least ascertaining a withdrawal velocity for the bank notes upon the dispensing/return of bank notes to be dispensed/returned using a sensor connected to the control device and configured to ascertain the withdrawal velocity;

controlling the transport system using the control device to transport the bank notes to be accepted at a transport velocity that corresponds substantially to the input velocity or the withdrawal velocity; and controlling the transport system using the control device to transport the bank notes to be dispensed/returned at a transport velocity that corresponds substantially to the withdrawal velocity or the input velocity.

9. The method according to claim 8, including the steps:

controlling the transport of the bank notes to be dispensed/returned by a specified length out of the input and dispensing position and holding the bank notes to be dispensed/returned;

monitoring whether the bank notes are being moved out of the apparatus, and again controlling the transport of the bank notes out of the apparatus if the motion of the bank notes is detected upon monitoring.

10. The method according to claim 8, including the steps:

monitoring whether the bank notes are still being moved during the transport of the bank notes using the control device, and terminating the transport of the bank notes if the bank notes are no longer being moved.

11. The method according to claim 8, including the steps:

monitoring whether the bank notes have been transported or moved out of the input and dispensing position using the control device, and upon such occurrence terminating the transport of the bank notes.

* * * * *